United States Patent [19]

Koeneker et al.

[11] 4,273,259

[45] Jun. 16, 1981

[54] FLOOD CONTROL FOR A BEVERAGE VENDOR

[75] Inventors: William V. Koeneker, St. Louis; Franklin D. Newkirk, Florissant, both of Mo.

[73] Assignee: UMC Industries, Inc., Stamford, Conn.

[21] Appl. No.: 79,352

[22] Filed: Sep. 27, 1979

[51] Int. Cl.[3] ..... B67D 1/16

[52] U.S. Cl. ..... 222/108; 137/312

[58] Field of Search ..... 137/312, 313; 222/108; 194/13

[56] References Cited

U.S. PATENT DOCUMENTS

| | | | |
|---|---|---|---|
| 2,004,194 | 6/1935 | Lacy-Mulhall | 137/312 X |
| 3,794,219 | 2/1974 | Pitel et al. | 222/108 |
| 3,976,225 | 8/1976 | Koeneker | 222/108 |
| 4,007,856 | 2/1977 | Murphy et al. | 222/108 X |

*Primary Examiner*—Stanley H. Tollberg

*Attorney, Agent, or Firm*—Senniger, Powers, Leavitt and Roedel

[57] ABSTRACT

Flood control apparatus for a beverage vendor of the type comprising a cabinet and a water supply system including a line for bringing water into the cabinet to provide water for beverages and a valve in the line, the apparatus comprising a pan located beneath components of the water supply system within the cabinet for collecting water discharged upon a failure of any of the components, the pan having a portion free to move down under the weight of water collected in the pan and a switch actuated by said portion of the pan when it moves down for closing the valve to cut off the supply of water.

12 Claims, 6 Drawing Figures

FLOOD CONTROL FOR A BEVERAGE VENDOR

BACKGROUND OF THE INVENTION

This invention relates to flood control apparatus for either a hot drink or a cold drink vendor (i.e., a control for preventing flooding in the event of a failure of the water system of the vendor).

The invention is in the same general class as the flood control shown in the co-assigned U.S. Pat. No. 3,976,225, and may be regarded as involving improvements thereover.

SUMMARY OF THE INVENTION

Among the several objects of this invention may be noted the provision of improved flood control apparatus with electrical components isolated from splashing of water to avoid malfunction; and the provision of such apparatus with simplified collection for both flood water and drainage from the cup station.

In general, flood control apparatus of this invention comprises a pan located beneath components of a water supply system in a vendor cabinet to collect water discharged upon a failure of any of the components, which pan has a portion free to move down under the weight of water collected in the pan, means in the cabinet supporting the pan, and means engagable by said portion of the pan for closing a valve in the water supply system to cut off the supply of water to the cabinet.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
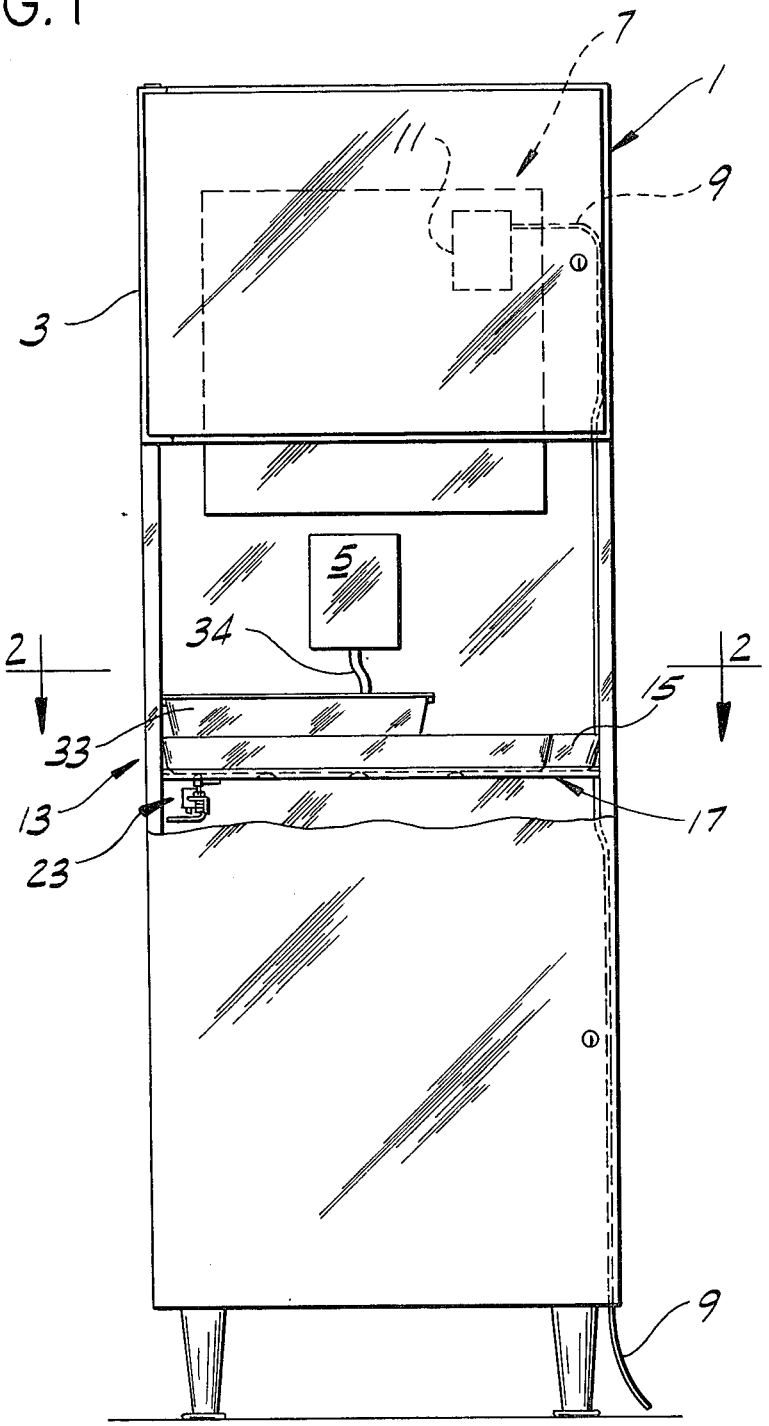
FIG. 1 is a front elevation of a beverage vendor with parts broken away showing flood control apparatus of this invention.

Referring to the drawings, a flood control apparatus of this invention is shown in a beverage vendor generally indicated at 1. The latter, which may be a hot drink or cold drink vendor, generally comprises a cabinet 3, a station 5 where a cup is placed for delivery of the beverage, a water supply system 7 including piping 9 for bringing water into the cabinet 3 for the beverages to be dispensed and a normally closed solenoid-operated valve 11 for controlling the supply of water to the vendor 1.

Figure 3:
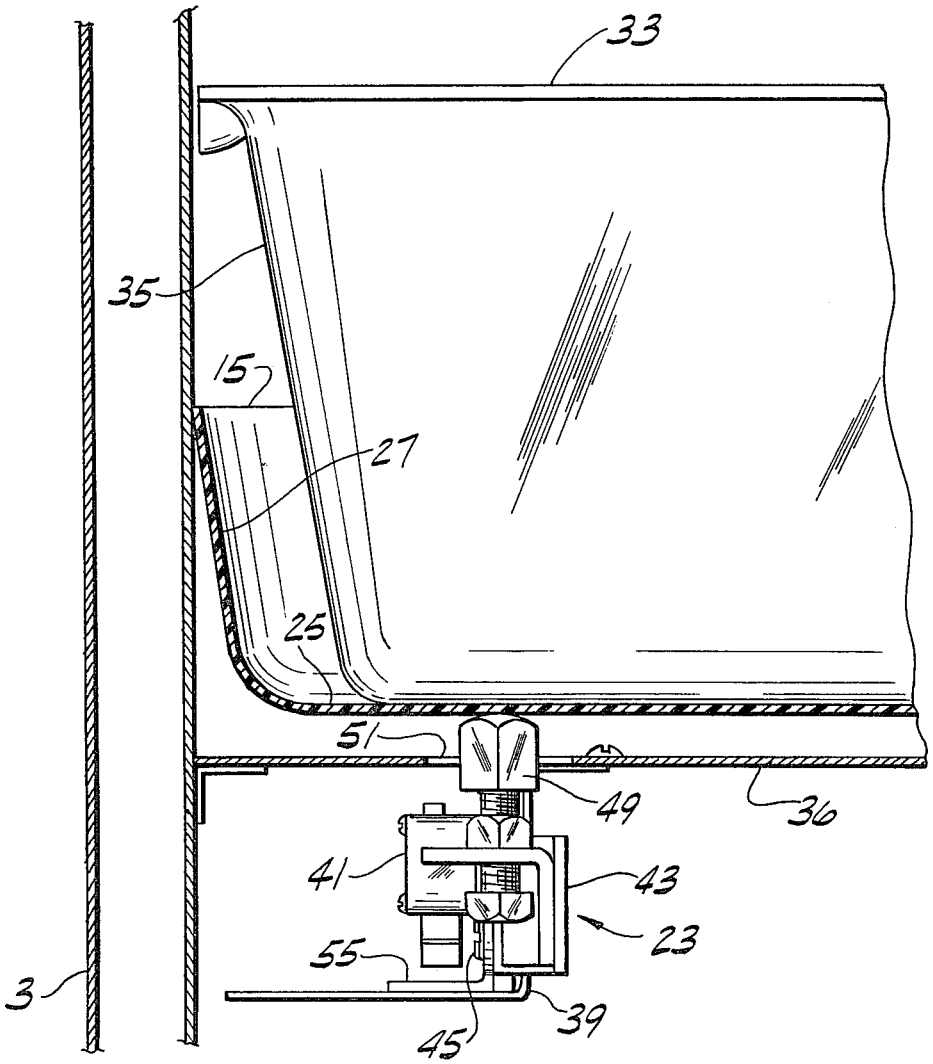
FIG. 3 is an enlarged view generally on line 3—3 of FIG. 2.
Figure 4:
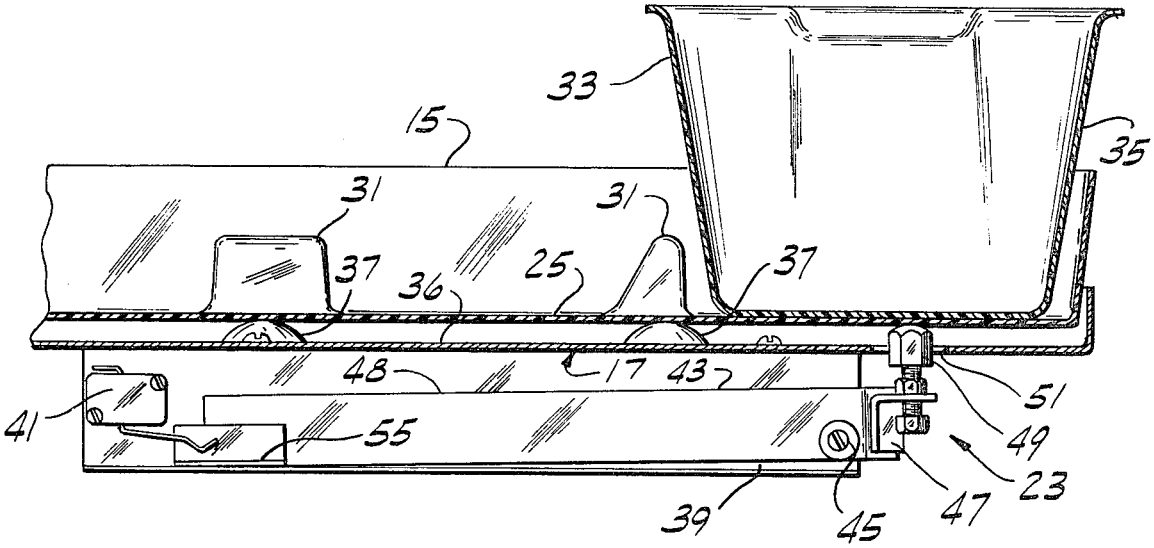
FIG. 4 is an enlarged view generally on line 4—4 of FIG. 2 showing a switch actuating mechanism of the apparatus in its lowered position.
Figure 5:
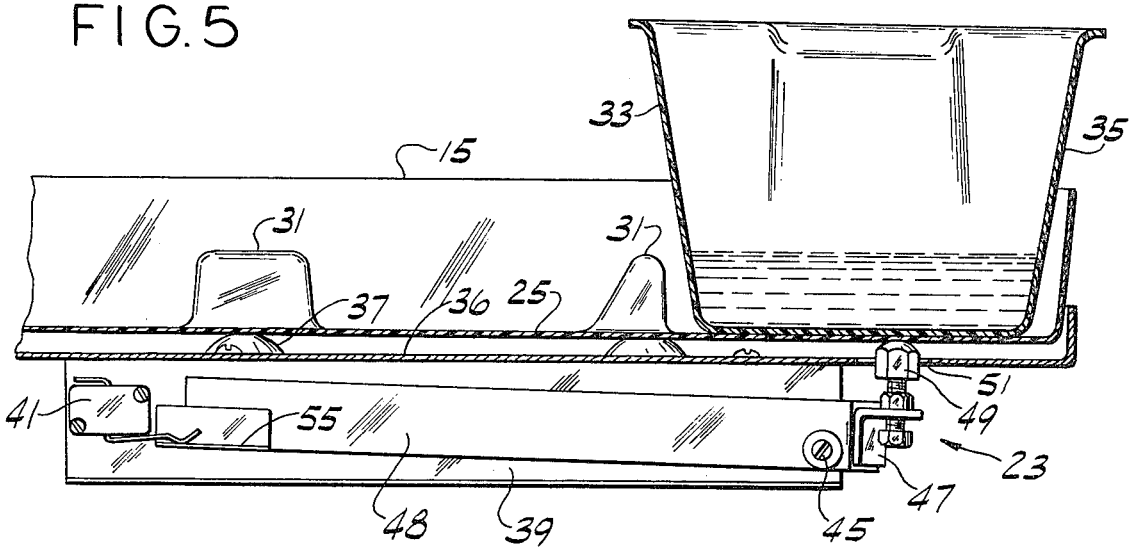
FIG. 5 is a view similiar to FIG. 4 showing the switch actuating mechanism in its raised position.
Figure 6:
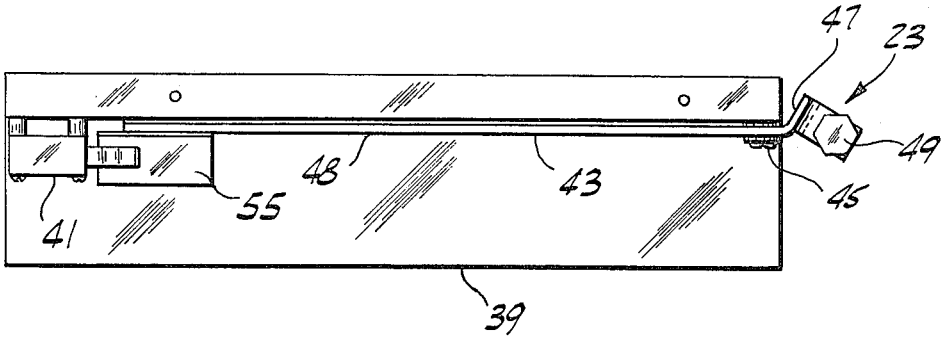
FIG. 6 is a plan of the switch actuating mechanism.

The flood control apparatus, which is generally indicated at 13, comprises a pan 15 located beneath components of the water supply system 7 in the cabinet to collect water discharged upon a failure of any of the components above the pan, means 17 in the cabinet 3 for supporting the pan 15 with a first portion or part 19 of the pan free to move downwardly and a second portion 21 of the pan supported on the supporting means 17, and means 23 engagable by the first portion 19 of the pan for closing the valve 11 to cut off the supply for water to the vendor 1 (see FIGS. 3–5).

In particular, the pan 15 has a bottom 25 and upstanding side walls 27 and is formed of an elastically deformable material such as for example commercially available acrylonitrile-butadiene-styrene (ABS) plastic. The pan 15 spans the width and depth of the cabinet 3 so as to extend beneath the components of the water supply system 7 in the cabinet 3.

Figure 2:
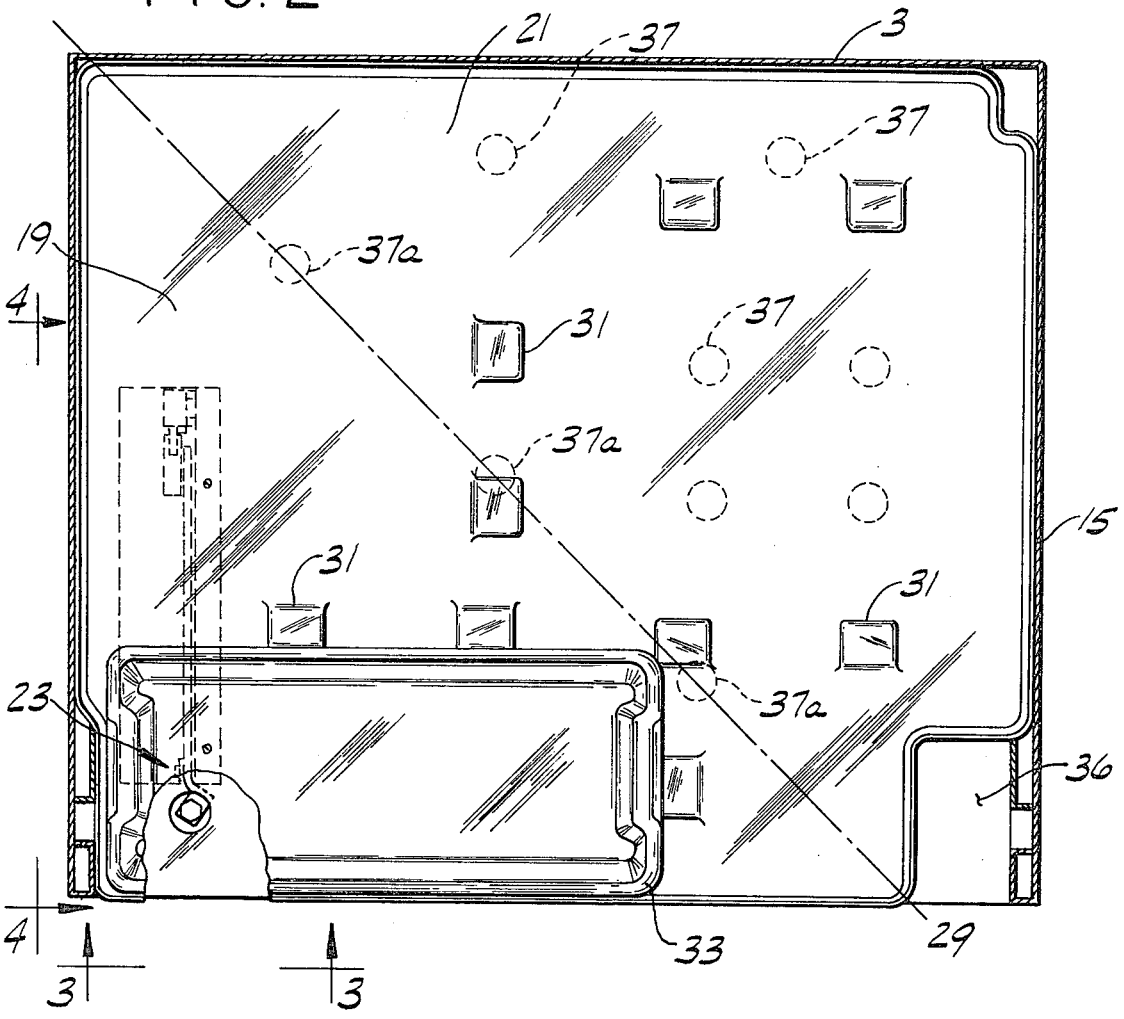
FIG. 2 is an enlarged horizontal section generally on line 2—2 of FIG. 1.

As shown in FIG. 2, a line 29 divides the pan 15 into the first portion 19 and the second or supported portion 21. The pan is sufficiently flexible as to enable the first portion of the pan to deflect downwardly about the line 29 under the weight of the water collected in the pan 15 without tipping of the pan about the line, the distance the first portion deflects being a function of the level of the water in the pan. As further shown in FIG. 2, the line 29 may extend along a diagonal of the pan 15. Such orientation of the line 29 is desirable for the proper downward deflection of a pan 15 constructed of ABS plastic.

A plurality of embossments 31 extend upwardly from the otherwise flat bottom 25 of the pan 15. The embossments 31 on the first portion 19 of the pan are adapted to receive the lower end of a container (waste bucket) 33 which collects drainage liquid from the cup station 5 via a drain line 34, the first portion 19 deflecting downwardly about the line 29 under the weight of the drainage liquid collected in the container. The embossments 31 on the second portion 21 are adapted to receive means (not shown), such as a carbonator for a cold drink vendor or a canister of coffee for a hot drink vendor.

The container 33 has sides 35 spaced from the sides 27 of the pan, so that any liquid overflowing the container will flow into the pan 15. As shown in FIGS. 1 and 2, the container 33 is located adjacent the door of the cabinet 3, so as to be readily accessible to service personnel for being emptied.

The means 17 for supporting the pan 15 comprises a generally horizontal panel 36 secured at its edges to the sides and back of the cabinet 3 (see FIGS. 2–5). The panel 36 has a plurality of upstanding projections 37 which at their upper ends support the bottom 25 of the second portion 21 of the pan 15. Certain of the projections (i.e., projections 37A) define the line 29 which separates the first and second portions of the pan 15. The upper surface of the panel 36 extends beyond the projections 37A below the first portion 19 of the pan 15.

The means 23 engageable by the first portion 19 of the pan 15 for closing the valve 11 comprises a bracket 39 secured to the bottom of the panel 36 and extending downwardly, a switch 41 secured to the bracket 39 and lever means 43 pivotally mounted on a pin 45 extending horizontally from the bracket 39 for pivotal movement between a retracted position (FIG. 4) and an operative position (FIG. 5) in which the lever means is engageable with the trip arm of the switch 41 for actuating the switch. With the switch 41 and the lever means 43 located beneath the pan 15 and the panel 36, these elements are protected against exposure to the drainage liquid from the cup delivery station 5, as well as the water discharged upon a failure of a component of the water supply system 7. Thus, malfunctioning of the flood control apparatus due to moisture on the switch 41 and to fouling of the means for actuating the switch by the drainage liquid is prevented.

The lever means 43 has first and second arms 47 and 48, respectively. The first arm 47 extends to one side of the pin 45 and has an upstanding pan abutment member such a heated bolt 49 adjustably secured thereon at its end away from the pin 45. The pan abutment member 49 extends up through a hole 51 in the panel 36 into engagement with the bottom 25 of the first portion 19 of the pan 15. The second arm 48 of the lever 43 extends to the other side of the pin 45 and has a switch actuating member 55 secured at its end remote from the pin 45. The second arm 48 is substantially longer than the first arm 47, thus biasing the lever 43 to its retracted position (wherein the end of arm 48 is down) and multiplying the movement of the first arm 47 so that a slight downward movement of the pan abutment member (e.g., 1/16") is sufficient to cause the switch actuating member 55 to move a much greater distance into engagement with the trip arm of switch 41. By adjusting the position of the headed bolt 49 on the first arm 47, the downward deflection of the first portion 19 of the pan 15 necessary to cause actuation of the switch 41 can be set at a predetermined value. When the lever 43 is in its retracted position (FIG. 4), electrical circuits in the the switch 41 are closed to supply power to the vendor 1 for its operation and to energize the solenoid-operated valve 11 to an open position for allowing water to enter the vendor via the water supply system 7. In the event the lever 43, in response to the downward deflection of the first portion 19 of the pan 15 under the weight of the water in the pan 15 or the drainage liquid in the container 33, pivots in clockwise direction as shown in FIG. 5 to trip the switch 41, the circuits in the switch 41 open to deenergize the vendor 1 and the solenoid-operated valve 11. When deenergized, the vendor 1 no longer operates to dispense drinks therefrom. Valve 11 when deenergized, is closed to shut off the supply of water to the vendor 1. Thus, flooding of the vendor 1 by either overflow from container 33 or water discharged upon failure of a component of the water supply system 7 is prevented.

In the operation of the flood control apparatus 13, the circuits in the switch 41 are normally closed for energizing the vendor 1 and the solenoid operated valve 11. As drainage liquid from the cup station 5 collects in the container 33, the first portion 19 of the pan 15 deflects downwardly, thereby causing the lever 43 to pivot upwardly. When the first portion 19 of the pan 15 has deflected down a predetermined distance, switch actuating member 55 on arm 48 of lever 43 engages the trip arm of switch 41, the circuits in switch 41 are opened, and the vendor 1 and the solenoid-operated valve 11 are deenergized, thereby preventing further operation of the vendor 1 and interrupting the supply of water to the vendor 1 to prevent flooding thereof. After service personnel has emptied the container 33, the vendor 1 and valve 11 are reenergized and the vendor can again be used for dispensing drinks. In the event of a failure of one or more components of the vendor water supply system 7, the escaping water pours downwardly and collects in the pan 15 and container 33. The first portion 19 of the pan 15 deflects down under the weight of the water collected therein. When the first portion has deflected down a predetermined distance, the vendor 1 and the solenoid operated valve 11 are deenergized by the switch 41, thereby preventing further operation of the vendor 1 and interrupting the supply of water to the vendor to prevent flooding thereof.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A flood control apparatus for a beverage vendor of the type comprising a cabinet, a station where beverage is delivered into a cup, a water supply system including a line for bringing water into the cabinet to provide water for beverages, and a valve in said line; said control means comprising:

a pan having a bottom and upstanding side walls, the pan being located beneath components of the water supply system within the cabinet to collect water discharged upon a failure of any of the components, said pan being adapted resiliently to flex downward at least in part under the weight of water collected in the pan;

means in the cabinet for supporting the pan with said part of the pan free to flex downward under the weight of water collected in the pan; and means engageable by said part of the pan on said downward flexing thereof for closing the valve to cut off the supply of water, said means for closing the valve being actuated to close the valve upon said part flexing downward under the weight of the water collected in the pan.

2. Flood control apparatus as set forth in claim 1 wherein the pan generally spans the width and depth of said cabinet.

3. Flood control apparatus as set forth in claim 1 wherein said part of the pan constitutes a first portion of the pan, said means supporting the pan having an upper surface that engages the bottom of a second portion of the pan and extends beneath said first portion thereof.

4. A flood control apparatus for a beverage vendor of the type comprising a cabinet, a station where beverage is delivered into a cup, a water supply system including a line for bringing water into the cabinet to provide water for beverages, and a valve in said line; said control means comprising:

a pan having a bottom and upstanding side walls, the pan being located beneath components of the water supply system within the cabinet to collect water discharged upon a failure of any of the components and having a portion constituting a first portion of the pan free to move down under the weight of water collected in the pan;

means in the cabinet for supporting the pan having an upper surface that engages the bottom of a second portion of the pan and extends beneath said first portion thereof, the upper surface of the supporting means having a plurality of upstanding projections, the projections at their upper ends supporting the second portion of the pan at its bottom; and means engageable by said first portion of the pan for closing the valve to cut off the supply of water, said means for closing the valve being actuated to close the valve upon said first portion moving down under the weight of the water collected in the pan.

5. A flood control apparatus for a beverage vendor of the type comprising a cabinet, a station where beverage is delivered into a cup, a water supply system including a line for bringing water into the cabinet to provide water for beverages, and a valve in said line; said control means comprising:

a pan having a bottom and upstanding side walls, the pan being located beneath components of the water discharged upon a failure of any of the components and having a portion constituting a first portion of the pan free to move down under the weight of water collected in the pan;

means in the cabinet for supporting the pan having an upper surface that engages the bottom of a second portion of the pan and extends beneath said first portion thereof, the pan being of elastically deformable material, the first portion of the pan deflecting downwardly under the weight of the water in the pan, the distance said first portion of the pan deflects being a function of the level of the water in the pan; and means engageable by said first portion of the pan for closing the valve to cut off the supply of water, said means for closing the valve being actuated to close the valve upon said first portion moving down under the weight of the water collected in the pan.

6. A flood control apparatus for a beverage vendor of the type comprising a cabinet, a station where beverage is delivered into a cup, a water supply system including a line for bringing water into the cabinet to provide water for beverages, and a valve in said line; said control means comprising:

a pan having a bottom and upstanding side walls, the pan being located beneath components of the water supply system within the cabinet to collect water discharged upon a failure of any of the components and having a portion constituting a first portion of the pan free to move down under the weight of water collected in the pan;

means in the cabinet for supporting the pan having an upper surface that engages the bottom of a second portion of the pan and extends beneath said first portion thereof; and means engageable by said first portion of the pan for closing the valve to cut off the supply of water, said means for closing the valve being actuated to close the valve upon said first portion moving down under the weight of the water collected in the pan, said closing means comprising a bracket secured beneath the means supporting the pan, lever means pivotally mounted on the bracket for pivotal movement about a horizontal axis between a retracted position and an operative position, and a switch for controlling the valve in the water line, said lever means being engageable with said switch to actuate said switch upon being pivoted to its said operative position.

7. Flood control apparatus as set forth in claim 6 wherein said lever means has a first arm on one side of the axis in engagement with the bottom of the first portion of the pan and a second arm on the opposite side of the axis engageable with the switch.

8. Flood control apparatus as set forth in claim 7 wherein said first arm has an upstanding pan abutment member adjustably secured at an end of the first arm away from said axis, said second arm having a switch actuating member at an end of the second arm remote from the axis.

9. Flood control apparatus as set forth in claim 8 wherein said second arm is longer than the first arm, the weight of the second arm biasing the lever means toward its retracted position.

10. Flood control apparatus as set forth in claim 9 wherein the pan abutment member extends through an opening in said means supporting the pan, the pan abutment member moving down upon the downward deflection of the first portion of the pan, thereby pivoting the lever means to move the switch actuating member upwardly toward the switch, the distance the switch actuating member moves up being greater than the distance the pan abutment member moves down.

11. Flood control apparatus as set forth in claim 1 further comprising a waste container positioned on said part of the pan, the container receiving drainage liquid from said station, said part of the pan flexing downward under the weight of the liquid collected in the container.

12. Flood control apparatus as set forth in claim 11 wherein said container has side walls spaced inwardly from the side walls of the pan, so that liquid overflowing the container flows into the pan.

* * * * *